US005550703A

United States Patent [19]

Beyer et al.

[11] Patent Number: 5,550,703

[45] Date of Patent: Aug. 27, 1996

[54] PARTICLE FREE IONIZATION BAR

[75] Inventors: Douglas H. Beyer, Cathedral City; Eugene V. Williams, Desert Hot Springs; Jose A. Alvarez, Palm Springs, all of Calif.

[73] Assignee: Richmond Technology, Inc., Redlands, Calif.

[21] Appl. No.: 392,379

[22] Filed: Jan. 31, 1995

[51] Int. Cl.[6] ..... H05F 3/06

[52] U.S. Cl. ..... 361/229; 361/213; 361/230

[58] Field of Search ..... 361/212, 213, 361/225, 229, 230, 231; 250/423 R, 324–326

[56] References Cited

U.S. PATENT DOCUMENTS

| | | | |
|---|---|---|---|
| 3,619,719 | 11/1971 | Waller et al. | 361/230 |
| 4,048,667 | 9/1977 | Brennecke | 361/213 |
| 4,333,123 | 6/1982 | Moulden | 361/213 |
| 4,528,612 | 7/1985 | Spengler | 361/213 |
| 4,635,151 | 1/1987 | Le Vantine | 361/213 |
| 4,750,080 | 6/1988 | Cumming et al. | 361/213 |
| 5,116,583 | 5/1992 | Batchelder et al. | 361/231 X |

*Primary Examiner*—Fritz M. Fleming
*Attorney, Agent, or Firm*—Stetina Brunda & Buyan

[57] ABSTRACT

An air ionizing device that prevents contaminant buildup on the electrodes, comprising a housing that includes a low pressure plenum that meters dry gas to flow near an electrode, and the electrode is surrounded by an annular shaped shroud. The housing and shroud are configured to provide a laminar flow of dry gas around the electrode, such that moist room-air is prevented from reaching the electrode during ionization. The device may further include a plurality of electrodes and shrouds spaced laterally along an elongate housing, and a high pressure plenum to distribute gas at a plurality of locations to the low pressure plenum. A plurality of mounting bars connect each of the electrodes to wiring inside the low-pressure plenum, the wiring routed to a high voltage power supply. The outside of the housing is formed of smooth concave-shaped surfaces to avoid interfering with existing room-air flow. The air-ionizing device is low maintenance and inexpensive to manufacture.

10 Claims, 1 Drawing Sheet

PARTICLE FREE IONIZATION BAR

FIELD OF THE INVENTION

The present invention relates generally to air ionizing devices which produce a flow of ionized gas to neutralize static charges, and more particularly to air ionizing devices which prevent contaminant buildup on electrodes.

BACKGROUND OF THE INVENTION

The problems associated with statically charged air particles in the vicinity of sensitive manufacturing processes and sensitive work pieces are not new. The build up of static charges on sensitive electronic components may lead to severe damage of those components. The localized static charges themselves may damage or degrade particularly sensitive electronics. More importantly, electrotatic forces on electronics surfaces create an electric field that attracts contaminants carried by the air. Dust particles in the air may be so small that they are little affected by gravity, but rather settleing of the dust particles is brought about by electrostatic forces.

Air ionizing apparatus are well known to dramatically reduce the deposition rate of small dust particles, by propelling ions into the air surrounding a work area to neutralize charged materials present. Partridge, U.S. Pat. No. 5,055,963 (issued Oct. 8, 1991) describes a housing with generally open inlet and outlet passages, and a fan and electrodes mounted inside the housing. The fan creates an air flow that pulls room-air through an opening in the back of the housing, and after being ionized the air is propelled out an opening in the front of the housing. Le Vantine, U.S. Pat. No. 4,635,161 (issued Jan. 6, 1987) discloses a device having dual air supplies that lead to a positive or negative electrode, and the ionized air is mixed in a vortex chamber. The ionized air is then propelled out the front of the device through small air jets.

Other prior art devices include air ionizing rings where high pressure air is supplied through a small gap in the ring, and flows through the ring past electrodes into the workstation. These air-ionizing rings are typically precision machined parts to provide the small gap and surfaces around which the air flows. Shims may be required to control the dimensions of the small gap.

Although the prior art devices have proven generally suitable for their intended purposes, they possess inherent deficiencies which detract from their overall effectiveness and desirability. Ionization takes place at the sharp pointed end of the electrode where an intense electric field develops called a corona. During ionization, the electrode tends to accumulate aluminum nitrate at the corona from moisture contained in the room air. Over time, this leads to a decreased output of ionized gas particles, and eventually the electrode must be cleaned or replaced. Also, contaminants on the electrode tips themselves tend to be discharged into the air during the ionization event.

It is recognized that it is important to produce a balanced number of positive and negative ions through properly functioning electrodes, to avoid actually contributing to the problem of static discharge in the vicinity of workpieces. Partridge disclosed wiring for a self-balancing circuit, where if the output of one charge changes relative to the other, the circuit re-equalizes itself by changing the output of the opposite charge. Other prior art devices have included conductive sensors to indicate when maintenance of an electrode is required.

The designs of the prior art devices also tend to interfere with the room air flow and lighting around the workstation. In clean room environments where electronics manufacturing typically takes place, filtered air and lighting are provided from overhead. The prior art devices tend to develop a turbulent air flow surrounding them, and cast a shadow across the workstation. The turbulent flow of air may also have the undesired effect of increasing combination of the positive and negative ions before they reach the electronics surface to be neutralized.

SUMMARY OF THE INVENTION

In view of the shortcomings of the prior art it is the object of the present invention to provide an air ionizing device that minimizes contaminate buildup on the electrodes. A further object of the present invention is to provide an air ionizing device that does not produce a turbulent flow of air in the workstation. Another object of the present invention is to provide an air ionizing device with a narrow profile to minimize interference with overhead lighting.

The present invention specifically addresses the above-mentioned objectives, and alleviates the above mentioned deficiencies associated with the prior art. More particularly, the present invention includes a housing having a low-pressure plenum, that receives and holds a dry, non-toxic gas at a higher pressure than the outside atmosphere in the workstation. A portion of the plenum is formed by a receptacle with apertures that allow gas to flow from the plenum. The gas flows sufficiently near an electrode, connected to a high voltage power source, that ionization occurs. An annular shaped shroud surrounds the electrode. The flow of the gas and the surrounding shroud prevent moist room air from reaching the electrode during the ionization event.

The preferred embodiment of the present invention includes an elongated housing with several receptacles laterally spaced apart along the housing, to provide coverage across an entire workbench or workstation. The extruded plastic housing may be fabricated to many different lengths. A high pressure plenum disposed in the housing distributes gas at a plurality of locations to the low pressure plenum. Also provided is the capability to attach together several sections of the elongate housing. The preferred embodiment further includes an exterior housing design formed having a smooth concave-shaped surface around the high and low pressure plenums. This enables room air to flow around the device with minimal turbulence.

The preferred embodiment includes an equalization chamber formed between the receptacle and shroud. After the gas passes through the apertures in the receptacle, it is collected in the equalization chamber until sufficient pressure develops that the inner surface of the shroud is deformed, forming a laminar flow channel between the shroud and the receptacle. This laminar flow channel creates a steady and continuous flow of gas past the electrodes and exiting through the shroud.

The wiring installation of the preferred embodiment includes a metal mounting bar installed in the receptacle, with one end inside the plenum and the other end protruding outside the plenum. The end of the mounting bar inside the plenum is electrically connected to the high voltage power source, and the other end has an electrode mounted thereto. A pair of wires are routed from the high voltage power source through the low pressure plenum and elongate housing to each of the receptacles. At the receptacle a portion of the insulating cover is removed from one of the wires, and that wire is electrically connected to the mounting bar.

Operation of the present invention to provide a flow of ionized gas for a workstation involves supplying gas into the low pressure plenum, and metering the gas through the apertures in the plenum. As the gas passes sufficiently near the electrodes ionization occurs. The ionized gas is directed through a shroud towards the workstation at a velocity approximately equal to the room air flow, and in a direction approximately parallel to the room-air flow. The laminar flow of ionized gas through the shroud prevents room air from reaching the electrodes. Turbulence in the room air is not generated nor is a shadow cast across the workstation. The device operates quietly, and the design is aesthetically pleasing.

These, as well as other advantages of the present invention will become more apparent from the following description and drawings. It is understood that changes in the specific structure shown and described may be made within the scope of the claims without departing from the spirit of the invention.

DETAILED DESCRIPTION OF THE PREFERRED EMBODIMENT

The detailed discussion set forth below in connection with the appended drawings is intended as a description of the presently preferred embodiments of the present invention, and is not intended to represent the only forms in which the present invention may be constructed or utilized. The description sets forth the functions and sequences of steps for constructing and operating the invention in connection with the illustrated embodiment. It is to be understood, however, that the same or equivalent functions and sequences may be accomplished by different embodiments that are also intended to be encompassed within the spirit and scope of the invention.

Figure 1:
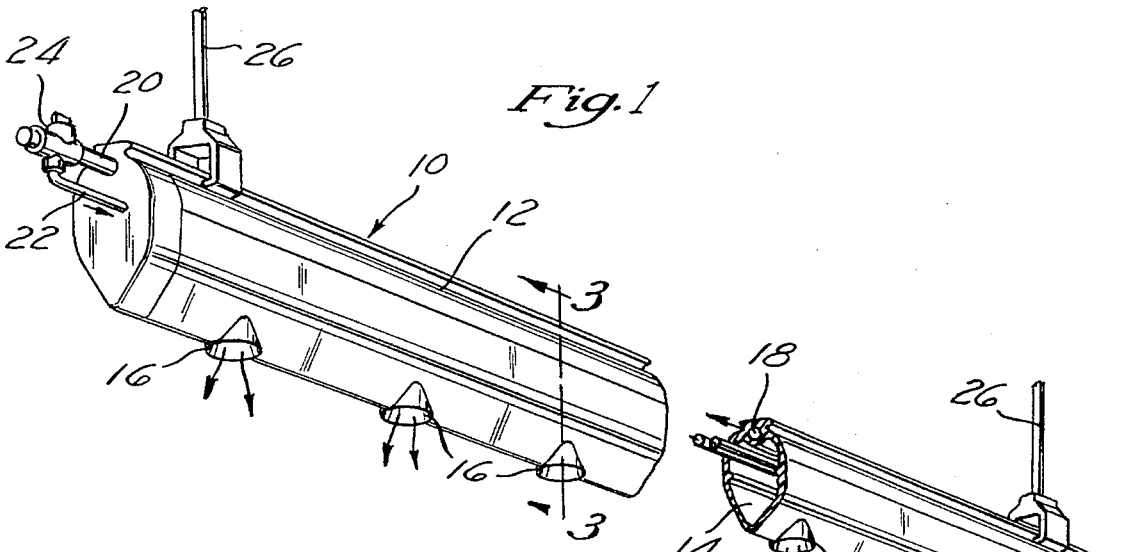
FIG. 1 is a perspective view illustrating the particle free air ionizing device in accordance with the present invention.

Referring generally to FIG. 1, the air ionizing device 10 includes a housing 12, preferably fabricated from an extruded plastic material. The housing has a low pressure plenum 14, that holds a supply of gas in the plenum 14, at a pressure greater than that of the outside atmosphere in the workstation. The gas is preferably nitrogen, or dry air, or some other non-toxic gas. The air ionizing device 10 has several shrouds 16, preferably fabricated from a moldable plastic material. The shroud 16 guides the ionized air towards the workstation. The shroud 16 of the preferred embodiment is preferably annular shaped, with a diameter of about ½ inch at the outlet end.

A high pressure plenum 18 receives the nitrogen through a delivery pipe 20, connected to a conventional high pressure storage tank (not shown). The high pressure plenum 18 distributes the gas at several locations (not shown) to the low pressure plenum 14. A return pipe 22 connects the low pressure plenum 14 to a conventional regulator valve 24, that may selectively adjust the pressure of the high pressure plenum 18 and the low pressure plenum 14. A pair of support clips 26 suspend the air ionizing device 10 from overhead to lie above the workstation. The housing 12 is approximately 36 inches in length, and the shrouds 16 spaced approximately 6 inches apart (center to center) from each other. The outside surface of the housing 12 is relatively smooth and concave-shaped, so that interference with the existing air flow from overhead is minimized. The profile of the housing 12 is also narrow, only approximately 1 inch wide, so that overhead lighting is not obstructed over a significant area of the workstation.

Figure 2:
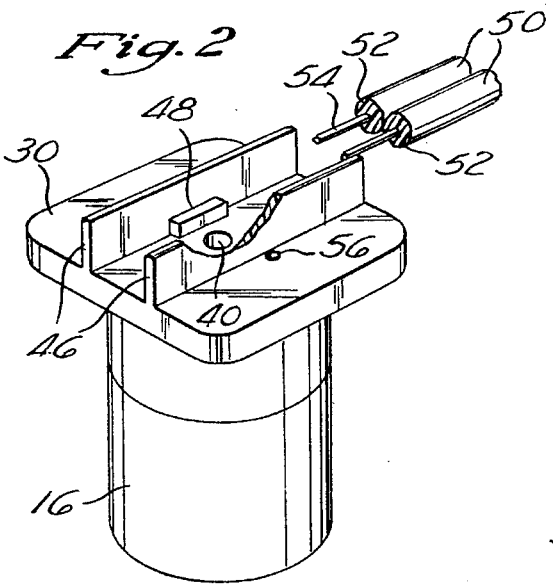
FIG. 2 is a reverse angle perspective view showing the detail of the receptacle and the components that assemble to it.
Figure 3:
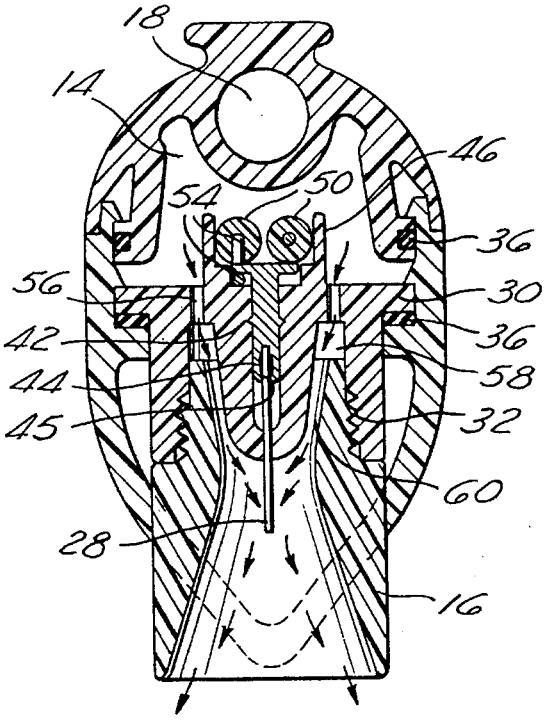
FIG. 3 is a cross-section view of the plenums and the air flow through the device.
Figure 4:
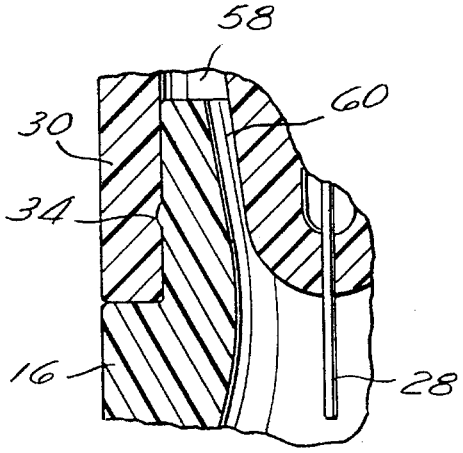
FIG. 4 is a detailed cross-section view showing the laminar flow channel.

Referring now to FIGS. 2 through 4, each shroud 16 surrounds an electrode 28. Each of the shrouds 16 is screwed onto a receptacle 30, by rotating the shroud 16 and engaging the threads 32. Alternatively, as shown in FIG. 4, the shroud 16 may be installed onto the receptacle 30 and held in place with an interference fit by a small bump 34 that extends around at least a portion of the outside perimeter of the shroud 16. The receptacle 30 is also preferably fabricated from a moldable plastic material. The receptacle 30 actually forms a portion of the plenum 14. A pair of conventional O-rings 36 act to seal the plenum 14 around the receptacle 30. The electrode 28 is attached to a metallic mounting bar 38 through a hole in the receptacle 30. A pair of barbs 42 on the outside of the mounting bar 38 hold the mounting bar 38 in place. A small clamp 44 inside a cavity 45 in the end of the mounting bar 38 holds the electrode 28 in place.

The details of the electrical connection from the electrodes to the high voltage power source will now be discussed. The pair of high voltage wires 50 are routed to the various receptacles 30 from a conventional high voltage power supply (not shown), which is preferably positioned within the housing 12. The receptacles 30 have a pair of upstanding channels 46 and a pair of mounting pads 48. In the vicinity of the mounting bar 38 at each of the receptacles 30, a portion of the insulating covering 52 is stripped away from one of the wires 50, depending on whether this particular electrode 28 is desired to emit positive or negatively charged particles. The conductor 54 is routed underneath the mounting bar 38, thereby making the electrical connection. The other wire 50 simply passes over the mounting bar 38 without any of the insulating cover 52 being stripped away.

Now the various gas flows through the air ionizing device 10 will be described. Referring to FIGS. 3 and 4, the gas in the plenum 14 passes through apertures 56 into an equalization chamber 58. The diameter of apertures 56 for this embodiment is 3/32 inch. As the pressure increases in the equalization chamber 58, the shroud 16 begins to deform away from the receptacle 30 forming a laminar flow channel 60. The former location of the shroud 16 is shown by the phantom lines 62. The gas flows through the laminar flow channel 60 and passes sufficiently near the electrode 28 that ionization occurs. The surface of the receptacle 30 near the electrodes 28 is a gentle curve design, so as not to disrupt the smooth flow of gas towards the electrodes 28. Then the ionized gas flows in a laminar fashion through the shroud 16 and towards the workstation. The ionized gas as released should parallel the direction of the existing room-air flow form overhead and be at approximately 90% of the velocity. The continuous and steady flow of gas during the ionization process prevents any of the moist room air from reaching the electrode 28. No deposits of aluminum nitrate accumulate at the end of the electrode 28.

The design of the shroud 16 and the receptacle 30, as well as the gas pressure from the low-pressure plenum 14, combine to define the laminar flow channel 60 and the gas flow past the electrodes 28 and through the shroud 16. The gas pressure in the equalization chamber 58 applies a uniformly distributed load onto the shroud 16 and receptacle 30. The shroud 16 is preferably fabricated from a more elastic material than the receptacle 30. The bearing stress developed from the pressure load causes the shroud 16 to yield, depending upon the bearing area and the elasticity of the material. Tests may be conducted on shrouds 16 and receptacles 30 of varying dimensions and materials. The gas pressure in the equalization chamber 58 may be adjusted by varying the size of the aperture 56 or by varying the gas pressure in the low-pressure plenum 14.

It is understood that the exemplary air ionizing device described herein and shown in the drawings represents only a presently preferred embodiment of the invention. Indeed, various modifications and additions may be made to the preferred embodiment without departing from the spirit and scope of the invention. The modifications and additions may be obvious to those skilled in the art and may be implemented to adapt the present invention for use in a variety of applications.

What is claimed is:

1. An ionizing device for providing a flow of ionized gas while preventing contaminant build up on electrodes, the device including:

a housing having a low-pressure plenum connectable to a pressurized gas supply, the low-pressure plenum having one or more apertures that allow gas flow from the low-pressure plenum;

a plurality of electrodes each electrically connectable to a high voltage power source, the electrodes attached to the housing sufficiently proximate one of the one or more apertures such that gas flow from the low-pressure plenum is ionized;

a plurality of annular-shaped shrouds each attached to the housing around one of the electrodes, such that gas flow from the low pressure plenum through the shrouds prevents room air from reaching the electrodes during ionization;

further including a high pressure plenum disposed in the housing, the high-pressure plenum connectable to the pressurized gas supply and in fluid communication with the low-pressure plenum; and further including a valve operative to selectively regulate the gas pressure in the high and the low-pressure plenums, the valve connectable to the pressurized gas supply and connected to each of the plenums.

2. The device of claim 1, wherein the shroud is releasably attached to the housing, to provide greater access to the electrode for maintenance of the electrode.

3. The air ionizing device of claim 1 wherein the outside of the housing substantially around the high and low-pressure plenums is formed as a smooth concave-shaped surface, enabling room air to flow around the device with minimal turbulence.

4. An air ionizing device for providing a flow of ionized gas while preventing contaminant buildup on electrodes, the device including:

a housing having a low-pressure plenum connectable to a pressurized gas supply;

a plurality of receptacles which form part of the low-pressure plenum, each receptacle having a plurality of apertures that allow gas flow from the plenum;

a plurality of electrodes each having one end attached to one of the receptacles outside the plenum, the electrodes electrically connectable to a high voltage power source, such that gas flow from the plenum sufficiently near the electrodes is ionized;

a plurality of annular-shaped shrouds each attached to one of the receptacles around the electrode, such that gas flow from the plenum through the shrouds prevents room air from reaching the electrodes; and wherein each attachment of the shroud to the receptacle forms an equalization chamber between the shroud and receptacle, such that gas flowing from the plenum first collects in the equalization chamber, and then flows near the electrode and through the shroud.

5. The air ionizing device of claim 4 wherein each attachment of the shroud to the receptacle forms a laminar flow channel between the shroud and receptacle, and each shroud is formed such that upon gas flowing the shroud deforms thereby enlarging the laminar flow channel.

6. The air ionizing device of claim 4 wherein each receptacle has a mounting bar fabricated from a conductive material disposed in an orifice in the receptacle, one end of the mounting bar inside the plenum and electrically connectable to the high-voltage power source, and the other end of the mounting bar outside the plenum and the electrode attached thereto.

7. The air ionizing device of claim 6 wherein the electrodes are electrically connected by a pair of conductive wires with insulating covering, the conductive wires routed inside the housing between the mounting bars, one of the conductive wires having a portion of the insulating covering removed to make an electrical connection to each of the mounting bars.

8. A method for providing a flow of ionized gas while preventing contaminant buildup on an electrode, including the steps of:

(a) providing a supply of gas to a low-pressure plenum;

(b) metering the gas through a plurality of apertures in the low-pressure plenum into a laminar flow channel towards an electrode;

(c) deforming a shroud thereby enlarging the laminar flow channel;

(d) ionizing the flow of gas that passes sufficiently near the electrode; and (e) directing the gas flow through the shroud and towards the work station, preventing room air from reaching the electrode during ionization.

9. The method of claim 8, further including the step of:

providing a supply of gas to a high-pressure plenum, and distributing the gas from the high-pressure plenum to the low-pressure plenum.

10. The method of claim 8, further including the step of collecting the metered gas in an equalization chamber before the collected gas reaches the laminar flow channel.

* * * * *